US005841945A

United States Patent [19]

Nishitani

[11] Patent Number: 5,841,945

[45] Date of Patent: Nov. 24, 1998

[54] VOICE SIGNAL COMPACTING AND EXPANDING DEVICE WITH FREQUENCY DIVISION

[75] Inventor: Shuji Nishitani, Kyoto, Japan

[73] Assignee: Rohm Co., Ltd., Kyoto, Japan

[21] Appl. No.: 361,388

[22] Filed: Dec. 22, 1994

[30] Foreign Application Priority Data

Dec. 27, 1993 [JP] Japan ..... 5-348550

[51] Int. Cl.[6] ..... G10L 3/02

[52] U.S. Cl. ..... 395/2.21; 395/2.2; 395/2.14

[58] Field of Search ..... 395/2.77, 2.76, 395/2.2–2.21, 2.94, 2.14; 381/29, 30, 34, 35, 36

[56] References Cited

U.S. PATENT DOCUMENTS

| | | | |
|---|---|---|---|
| 3,873,778 | 3/1975 | Mutsuura | 179/15.55 T |
| 3,936,611 | 2/1976 | Poole | 179/15.55 T |
| 3,975,763 | 8/1976 | Kitamura | 360/8 |
| 3,976,842 | 8/1976 | Hoyt | 179/15.55 T |
| 4,108,036 | 8/1978 | Slaymaker | 84/1.01 |
| 4,121,058 | 10/1978 | Jusko et al. | 179/15.55 T |
| 4,435,832 | 3/1984 | Asada et al. | 381/34 |
| 4,623,922 | 11/1986 | Wischermann | 358/160 |
| 4,627,090 | 12/1986 | Smith, III et al. | 381/34 |
| 5,231,669 | 7/1993 | Galand et al. | 381/36 |

*Primary Examiner*—Allen R. MacDonald
*Assistant Examiner*—Robert C. Mattson
*Attorney, Agent, or Firm*—Fay,Sharpe,Beall, Fagan,Minnich & McKee

[57] ABSTRACT

In the present invention, the voice signals are A/D converted at a predetermined period of t and are divided into two frequency sides, in that a high frequency side and a low frequency side, and the high frequency side voice signals are then converted into data having a lower sampling frequency than that of the A/D conversion after performing a voice tone level conversion toward a lower frequency side and without performing thinned out sampling of the high frequency side voice signals. On the other hand, the sampling data of the low frequency side are thinned out, therefore equivalently the sampling frequency is reduced. Thereby, the amount of data to be stored is reduced and the reduced data are stored in a memory. During reproduction the data of the high frequency side are restored through a voice tone level conversion toward the high frequency side, and the data of the low frequency side are reproduced after restoring the sampling frequency to the original frequency at the time of A/D conversion such as by sampling a plurality of same data or by producing interpolation data.

7 Claims, 3 Drawing Sheets

VOICE SIGNAL COMPACTING AND EXPANDING DEVICE WITH FREQUENCY DIVISION

BACKGROUND OF THE INVENTION

1. Field of the Invention

The present invention relates to a voice signal compacting and expanding device and in particular, a digital type voice signal compacting and expanding device for a telephone apparatus and a game machine having a voice signal recording function, a voice signal communication device and the like which records the voice signals in digital form so as not to significantly deteriorate the voice of the high tone side when reproducing the same as well as reduces the capacity of a memory which records the voice signals.

2. Description of the Background Art

A telephone apparatus having automatic answering and recording function which permits recording and reproducing voice signals, a game machine which permits recording voice signals and reproducing the same, a voice signal communication device and the like are devised to prolong the voice signal recording time even when the voice quality is somewhat deteriorated.

One of their measures is that the voice signals in their digital value phase are recorded after compacting the same and the compacted digital voice signals are expanded during reproduction thereof. Thereby the capacity of a memory which records voice signals is reduced and information as much as possible is recorded in the memory. Further, in another measure in order to decrease data amount in the digital phase, the analogue signals are digitalized by compacting logarithmically the level thereof, recorded the same in the memory, and when reproducing, the digital signals read out from the memory are converted into analogue signals and thereafter the analogue signals are exponentially expanded.

In a typical signal compacting and expanding in digital phase as represented by such as adaptive differential pulse code modulation (ADPCM) which is used such as in a telephone apparatus, digital data are bit-compacted in relation to the past bit data via a predetermined arithmetic processing and thereafter expanded. However, the voice signal compacting and expanding in the digital phase are performed by arithmetic processing based on a specific rule, in that the compacting and expanding includes a conversion from m bits to n bit (wherein m>n) and a backward conversion thereof, therefore the recording capacity is determined by the compacting method employed and the reduction thereof is limited so that a bit compacting exceeding beyond that determined by the bit compacting method employed can not be expected. Accordingly, the capacity of the memory which is used for recording the voice signals is set depending on the recording time of the voice signals.

Further, the memory capacity is tried to be reduced such as by a simple thinned out sampling during the A/D conversion of the voice signals, however, the frequencies from intermediate tone to high tone among voice frequencies are greatly deteriorated, therefore the reproduced voice is hardly intelligible.

On the other hand, the increase of the memory capacity increases the size of the device, moreover in some devices because of the structural limitation thereof a memory itself having a large capacity can not be mounted.

SUMMARY OF THE INVENTION

An object of the present invention is to provide a voice signal compacting and expanding device which permits to reduce the memory capacity and to record voice signals for a long time without much deteriorating the high tone side of the voice signals.

For achieving the above object, the voice signal compacting and expanding device according to the present invention comprises:

an A/D conversion circuit (hereinbelow simply called as A/D) which samples voice signals at a predetermined period of t and A/D converts the sampled voice signals;

a low pass digital filter which receives the output data from the A/D a high pass digital filter which receives the output data from the A/D and has a cutoff frequency at the low frequency side thereof which is connectable to a cutoff frequency characteristic at the high frequency side of the low pass digital filter;

a first data converting means which converts the output data from the low pass digital filter into thinned out data having a period of t×k (wherein k is an integer of 2 or more);

a second data converting means which converts P, (wherein P is an integer of 2 or more) pieces of the output data from the high pass digital filter into data having the period of t×k;

a first memory which receives the data converted by the first data converting means as first digital data values and the data converted by the second data converting means as second digital data values, and stores the same successively;

a control circuit which reads out at the same time the first and second digital values from the first memory at the period of t×k, stores the first digital values into a second memory and the second digital values into a third memory respectively, produces k pieces of data based on the first digital values stored in the second memory, outputs these respective data at the period of t successively and further outputs P pieces of data among the second digital values stored in the third memory successively at the period of t; and a D/A converting circuit which D/A converts the first and second digital values outputted from the control circuit.

In the present invention as explained above, the voice signals are A/D converted at a predetermined period t and are divided into two frequency sides, in that a high frequency side and a low frequency side, and the high frequency side voice signals are then converted into data having a lower sampling frequency than that of the A/D conversion after performing a voice tone level conversion toward a lower frequency side and without performing thinned out sampling of the high frequency side voice signals. On the other hand, the sampling data of the low frequency side are thinned out, therefore equivalently the sampling frequency is reduced. Thereby, the amount of data to be stored is reduced and the reduced data are stored in the memory. During reproduction the data of the high frequency side are restored through a voice tone level conversion toward the high frequency side, and the data of the low frequency side are reproduced after restoring the sampling frequency to the original frequency at the time of A/D conversion such as by sampling a plurality of same data or by producing interpolation data. Further, for the production of the interpolation data, the data of the number corresponding to the difference between the sampling data number during the A/D conversion and the sampling data number during storage into the memory are produced by making use of the current data and the data immediately before the current data which was held.

With the above measure the deterioration from intermediate tone frequencies to high tone frequencies among voice frequencies is limited, the voice signals are recorded and reproduced in an easily intelligible voice and as well as the capacity of the memory is reduced.

When the sampling frequency of the input voice signals is reduced by thinned out sampling, the frequencies of recorded voice signals frequently vary depending on the sound quality of high tone region among the voice signals.

However, in the present invention with regard to voice signals of high tone region the voice tone level conversion toward low tone region during recording is performed, therefore the frequency variation of the recorded voice signals is limited.

Further, when the voice tone level is converted toward low tone region, the recording interval is extended accordingly, however which has to be matched with the thinned out sampling period. Therefore, the sampling data are recorded at every predetermined interval corresponding to an integer multiple of the equivalent sampling period after thinning out and at the same sampling frequency for the A/D conversion the number corresponding to the integer multiple, and during reproduction contrary thereto the data of the above number are read out in accordance with the original sampling frequency.

Now, in voice signals during conversation, similar signals are repeated at a predetermined period for a certain interval, in particular with regard to high frequency region of the voice signals, the repeating period is short but appears frequenctly. Accordingly, the high frequency components of the voice signals are recorded by designating a predetermined interval and during reproduction thereof the recording data are repeatedly read out at a high sampling frequency for the predetermined interval, thereby the high frequency components in the voice signals can be reproduced in an artificial manner.

In the devices such as a telephone apparatus having an automatic answering and recording function, a game machine which enables recording and reproducing of voice signals and a voice signal communication device, the required sound quality of the voice signal frequencies is not so high as required for audio signals, and most of them are voice signals of conversation, therefore by means of the above explained processing of these kinds of voice signals, the voice signals are reproduced in an easily intelligible voice.

In particular, it is preferable to set the above predetermined interval as one having a period of about 250 Hz~350Hz, and further to set the high frequencies as ones of about 1 kHz~7 kHz. Further, when assuming a band frequency for the voice signals is 300 Hz~3400Hz, it is preferable to allot the frequencies of about 300 Hz~1800 Hz for the low frequency side and the frequencies of about 1800 Hz~3400Hz for the high frequency side.

BRIEF DESCRIPTION OF THE DRAWINGS

FIGS. 3(*a*)–3(*c*) are views for explaining the sampling data;

DESCRIPTION OF THE PREFERRED EMBODIMENT

Figure 1:
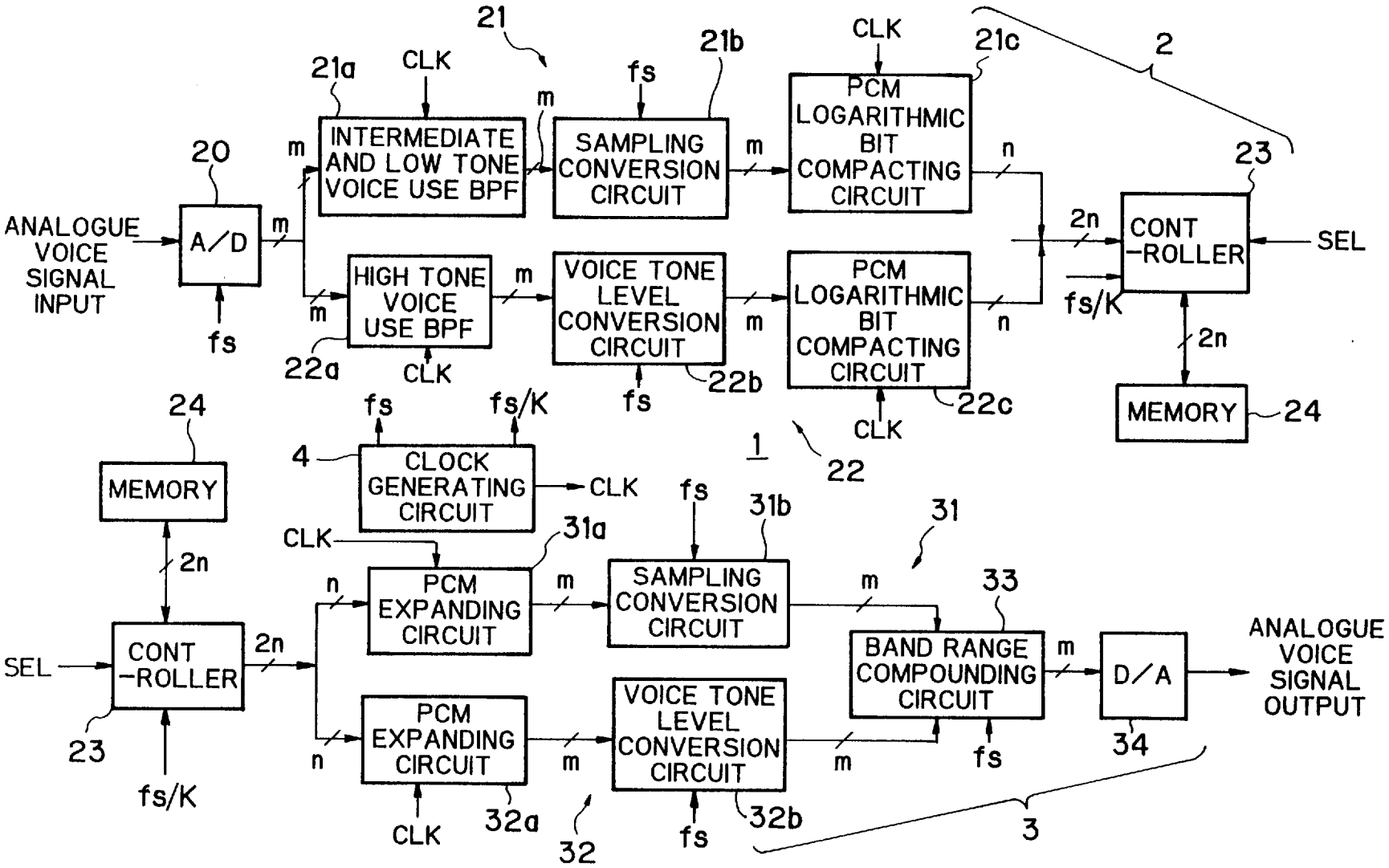
FIG. 1 is a block diagram of one embodiment to which the voice signal compacting and expanding device according to the present invention is applied.

In FIG. 1, numeral 1 is a voice signal compacting and expanding device, 2 a voice signal compacting circuit thereof, 3 a voice signal expanding circuit thereof and 4 a clock generating circuit. The clock generating circuit 4 generates clock signals of frequency $f_s$ and other clock signals of frequency $f_s/k$ in addition to clock signals CLK and sends out the same to the respective circuits.

The voice signal compacting circuit 2 is composed by an A/D 20, an intermediate and low tone voice compacting circuit 21 and a high tone voice compacting circuit 22 and is operated during recording of voice signals. The A/D 20 receives voice signals in analogue form from such as an audio amplifier, samples the same with clock signals of frequency $f_s$ (period t, thereof=$1/f_s$) and converts the same into digital data of m bit parallel, for example when m=8 into 8 bit parallel digital data. The intermediate and low tone voice compacting circuit 21 and the high tone voice compacting circuit 22 receive the converted 8 bit digital data from the A/D 20 and compact the received data.

The intermediate and low tone voice compacting circuit 21 is composed by an intermediate and low tone voice frequency use digital band pass filter (hereinafter simply called as intermediate and low tone voice use BPF) 21*a*, a sampling frequency conversion circuit (hereinafter simply called as sampling conversion circuit) 21*b* and a PCM logarithmic bit compacting circuit 21*c*. The intermediate and low tone voice use BPF 21*a* is designed to pass among the m bit digital data converted by the A/D 20 intermediate and low tone voice frequency components, for example components of a frequency band ranging 300Hz~1800 Hz or frequency components of less than either the upper or lower frequency of the frequency band range. The sampling conversion circuit 21*b* receives the output data of m bits from the intermediate and low tone voice use BPF 21*a*, thins out the received sampling data at the period k times larger than the sampling period of the A/D 20, namely at the frequency of $f_s/k$ and generates sampling data of m bits of the number smaller than the received data. The PCM logarithmic bit compacting circuit 21*c* logarithmically compacts from a linear PCM of the output data of m bits from the sampling conversion circuit 21*b* into n bit parallel data. Wherein m>n and, for example, n=4.

The high tone voice compacting circuit 22 is composed of a high tone voice frequency use digital band pass filter (hereinafter simply called as high tone voice use BPF) 22*a*, a voice tone level converting circuit 22*b* and a PCM logarithimic bit compacting circuit 22*c*. The high tone voice use BPF 22*a* is a filter having a lower side frequency connectable to the higher side cutoff 21*a*, frequency of the intermediate and low tone voice use BPF 21*a*, and passes among the m bit data converted by the A/D 20 during voice signal recording high frequency voice signals, for example those of about 1800 Hz~3400 Hz. The voice tone level converting circuit 22*b* performs the voice tone level conversion of the m bit output data from the high tone voice use BPF 22*a* with the clock signals having frequency of $f_s/k$ into low frequencies. Further, the PCM logarithmic bit compacting circuit 22*c* logarithmically compacts from a linear PCM of the m bit output data from the voice tone level converting circuit 22*b* into n bit parallel data.

The n bit output data from the PCM logarithmic bit compacting circuit 21*c* and the n bit output data from the PCM logarithmic bit compacting circuit 22*c* are sent out to a controller 23 as output data of 2n bits=upper digit bits+ lower digit bits which are composed, for example, by determining the bit data output from the PCM logarithmic bit compacting circuit 21*c* as the upper digit bits and the bit data outputted from the PCM logarithmic bit compacting circuit 22*c* as the lower digit bits. During recording of the voice signals the controller 23 successively records the received 2n bit data at respective addresses of a memory 24 in response to clock signals having frequency of $f_s/k$ (period t×k).

The voice signal expanding circuit 3 is composed by an intermediate and low tone voice expanding circuit 31, a high tone voice expanding circuit 32, band range compounding circuit 33 and a D/A conversion circuit 34 and is operated during reproduction of the voice signals. During the reproduction of the voice signals, the controller 23 successively reads out the respective 2n bit data stored at respective addresses in the memory 24 in accordance with the clock signals having the frequency of $f_s/k$ (period of t×k), and sends out among the read out data n bit data in upper digits to the intermediate and low tone voice expanding circuit 31 and n bit data in lower digits to the high tone voice expanding circuit 32 respectively.

Further, the controller 23 initiates the recording operation or the reproducing operation upon receipt of a selection signal SEL designating recording or reproducing of voice signals from an external device, and the voice signal compacting circuit 2 and the voice signal expanding circuit 3 also receive the selection signal SEL and perform their operations respectively during recording or reproducing. In the drawing, for the sake of convenience for explanation two sets of controller 23 and memory 24 are illustrated in right and left sides, however these are the same circuits.

The intermediate and low tone voice expanding circuit 31 is composed by a PCM expanding circuit 31*a* and a sampling conversion circuit 31*b*. The PCM expanding circuit 31*a* receives the n bit data in the upper digits read out from the memory 24 in response to the clock signals having the frequency of $f_s/k$ (period of t×k) and performs an expansion conversion on the received data from the logarithmic PCM to a linear PCM via an exponential expansion to form the original 8 bit parallel data. The sampling conversion circuit 31*b* generates the same data read out in response to clock signals having the frequency of $f_s/k$ (period of t×k) for k times and converts the read out data into sampling data having the sampling frequency of $f_s$ (period of t). Further, as an alternative which will be explained later, the data of k pieces are prepared by generating interpolation data. Wherein k is a value which supplements the difference between the number of the sampling data when the input signals are A/D converted and the number of the sampling data after performing the thinned out conversion. The 8 bit output data from the sampling conversion circuit 31*b* are sent out to the band range compounding circuit 33.

The high tone voice expanding circuit 32 is composed by a PCM expanding circuit 32*a* and a voice tone level conversion circuit 32*b*, and the 8 bit output data from the voice tone level conversion circuit 32 are sent out to the band range compounding circuit 33. The PCM expanding circuit 32*a* receives the n bit data in the lower digits read out from the memory 24 in response to clock signals having the frequency of $f_s/k$ (period of t×k) and performs an expansion conversion of the received data from the logarithmic PCM to a linear PCM via an expornential expansion to form the original 8 bit parallel data. The voice tone level conversion circuit 32*b* repeatedly reads out by k times in response to the clock signals having the high sampling frequency $f_s$ (period of t) of the sampling data stored according to the clock signals having the low frequency of $f_s/k$ (period of t×k) to thereby converts the data into the sampling data to the original signals having high frequencies. The 8 bit output data from the voice tone level conversion circuit 32*b* are sent out to the band range compounding circuit 33.

The band range compounding circuit 33 adds and compounds the m bit data from the intermediate and low tone voice expanding circuit 31 and the m bit data from the high tone voice expanding circuit 32 in response to the clock signals having frequency of $f_s$ and restores in an artificial manner the 8 bit data before the compacting. The restored 8 bit data are sent out to the D/A conversion circuit 34, are returned to analogue signals and outputted to such as an audio use amplifier circuit. Further, the analogue signals are sent out via such as the audio use amplifier circuit to a speaker and converted there into voices.

Now, a specific example of the sampling conversion circuit 21*b*, the voice tone level conversion circuit 22*b* and the voice tone level conversion circuit 32*b* which perform the above explained processings is explained with reference to FIG. 2(*a*) and FIG. 2(*b*).

The sampling conversion circuit 21*b* and the voice tone level conversion circuit 22*b* store the input signals in the order of input with regard to the storing operation, and read out and output the data in the order of storage time order among the data not yet read out with regard to reading out operation, namely are constituted based on a first in first out (FIFO) memory. The speed of the reading out use clock signals is $f_s/k$ (period of t×k). Further, the FIFO memory is a well know memory in the field of semiconductor memories.

Figures 2A, 2B:
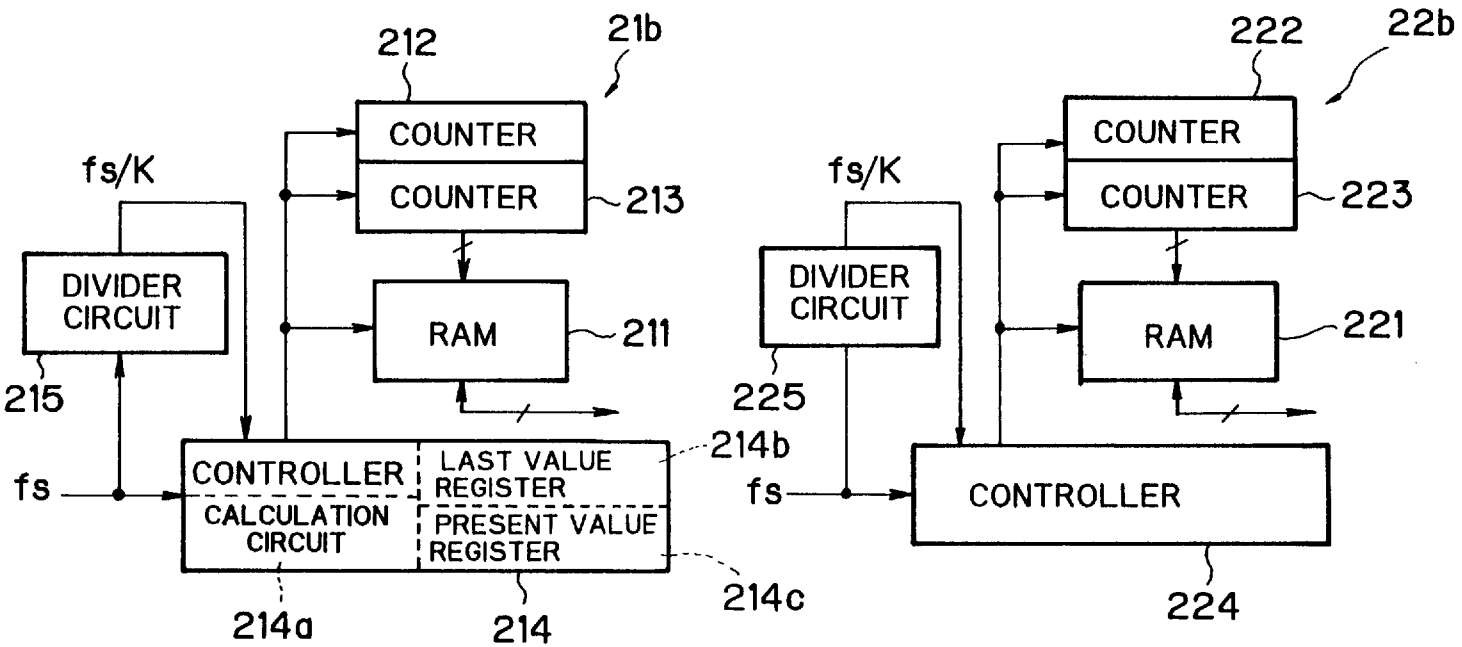
FIG. 2(*a*) is a view for explaining the sampling frequency converting circuit and FIG. 2(*b*) is a view for explaining the voice tone level converting circuit.

As illustrated in FIG. 2(*a*), their specific circuits are, for example, constituted such as by a memory unit in a form of a RAM 211 of a digital memory, a first counter 212 indicating storage addresses of input data, a second counter 213 indicating reading out addresses of output data, a controller 214, a divider circuit 215 and a gate (not shown).

Figure 3A:
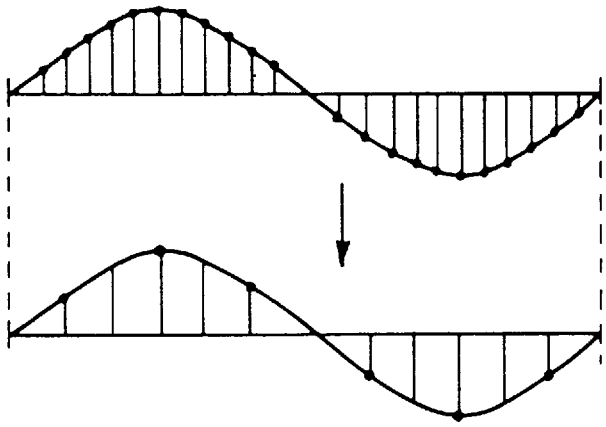
FIG. 3 is a view for explaining a sampling data processing in the voice tone level conversion.
Figure 3B:
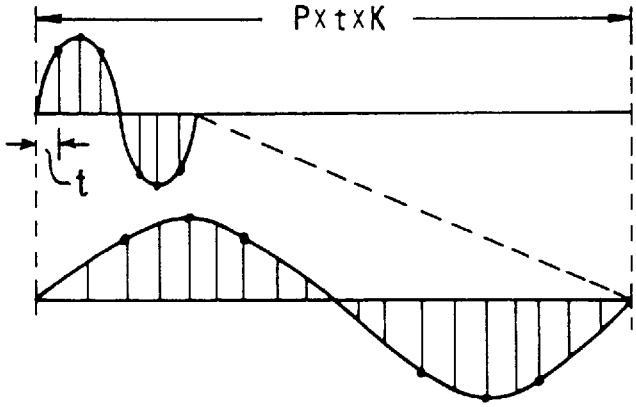
Figure 3C:
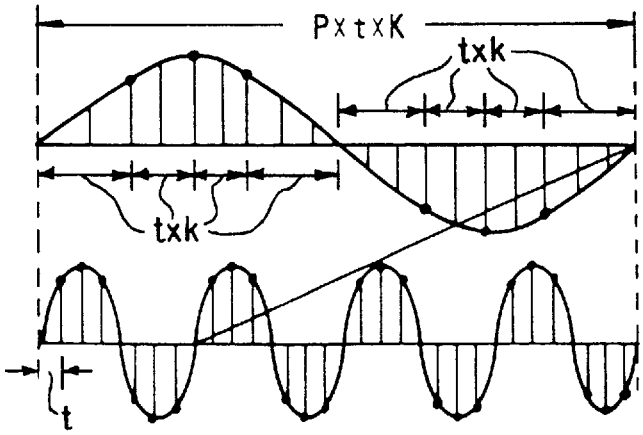

The controller 214 writes the 8 bit data from the intermediate and low tone voice use BPF 21*a* into the RAM 211 in accordance with the first counter 212 which is counted up by the clock signals having the frequency of $f_s$ (period t) and in synchronism with the sampling timing of the A/D 20 during the writing operation, and during reading out operation the controller 214 divides the clock signals having frequency $f_s$ into 1/k, increments the second counter 213 by every +k addresses with the clock signals having the frequency of $f_s/k$ (period of t×k) and reads out data at an interval covering (k−1) addresses. Through this operation the thinned out sampling data are produced. FIG. 3(*a*) shows a conversion of a sampling frequency into a lower frequency, in that the sampling data for the waveform of 1 kHz are thinned out and the number of data is decreased. In this instance the frequency $f_s$ is assumed to be a higher frequency more than 8 kHz with respect to above mentioned 1 kHz. Further, the reading out operation from the RAM 211 is initated after a certain amount data are stored in the RAM 211 after the initiation of the writing operation which is performed in response to a selection signal SEL inputted from the external device representing either recording or reproducing, for example when the selection signal SEL represents a recording signal a reading out initiating signal is produced after a predetermined delay time from a writing initiating signal which is generated in response to the selection signal SEL representing the recording. Further, the accessing operation of the controller 214 to the RAM 211 is performed in such a manner that when the last address is reached the accessing operation again returns to the first address.

The voice tone level conversion circuit 22*b* is constituted in the like manner as above and more specifically as illustrated in FIG. 2(*b*) constituted such as by a memory unit in a form of a RAM 221 of a digital memory, a first counter 222 indicating addresses at which input data are to be stored, a second counter 223 indicating addresses from which output data are to be read out, a controller 224, a divider circuit 225 and a gate (not shown).

When assuming the upper waveform as illustrated in FIG. 3(*b*) as the output waveform from the high tone voice use BPF 22*a*, the controller 224 writes the output waveform as P (P is an integer more than 1) pieces of sampling data received from the high tone voice use BPF 22*a* according to the first counter 222 which is designed to be counted up at every period of P×t×k by clock signals having frequency of $f_s$ at the addresses indicated thereby in the RAM 221 and in synchronism with the sampling timing of the A/D 20. Namely, this operation is such process wherein P pieces of data corresponding to one cycle of an output waveform having a certain frequency, for example 1 kHz is received, the received data are sampled by clock signals having the frequency of $f_s$ and stored, and after P×t×k period again other P pieces of data are stored in the same manner. Accordingly, the sampling number of an output waveform having another frequency varies depending on the frequency.

During reading out operation, the second counter 223 is incremented by every +1 address by clock signals having frequency of $f_s/k$ (period of t×k) formed by dividing clock signals having frequency of $f_s$ into 1/k, and the stored data are successively read out from the addresses in the RAM 221 indicated by the second counter 223.

As a result, as illustrated at the lower portion in FIG. 3(*b*) the period of the read out waveform is extended to k times, in other words the frequency thereof is reduced to 1/k. Further, in order to read out data uninterruptedly, the writing operation is preceeded and the reading operation is performed after storing more than k pieces of data which is performed, as explained above, by using a write initiating signal generated in response to a selection signal SEL after a predetermined delay time as a read out initiating signal.

As explained above, P pieces of sampling data of an output waveform having a certain frequency are sampled by clock signals having the frequency of $f_s$ are writen at every period of P×t×k and the reading out speed is reduced to 1/k in comparison with the above writing speed, thereby the voice frequency at the input side is reduced to 1/k. As a result, number of data to be stored via the controller 224 is reduced to 1/k. Further, when the storage area of the RAM 221 is filled, the same operation can be repeated if the counter 222 and the counter 223 are reset or, in the same manner as above the operation can be continued if the accessing of the controller 224 to the RAM 221 is returned from the last address to the first address.

FIG. 3(*b*) shows an exemplary voice tone level conversion wherein it is assumed that t=8 and the sampling data at the dotted positions are converted into sampling data of the frequency of 250 Hz.

The voice tone level conversion circuit 32*b* at the reproduction side is constituted in the same manner as the voice tone level conversion circuit 22*b* and only the manner of control of the controller 224 differs. Therefore, the control thereof is explained with reference to the circuit as shown in FIG. 2(*b*).

Contrary to the operation of the voice tone level conversion circuit 22*b*, the controller 224 stores one piece of sampling data at the clock signal speed of the frequency of $f_s/k$ (period of t×k) during writing operation and at the clock signal speed of the frequency of $f_s$ (period t) during reading out operation but the reading out points thereof are firstly different. Accordingly, the input data expanded into 8 bit data are successively written into the RAM 221. Further, during the reading out operation the controller 224 reads out k times repeatedly P pieces of the data as a unit as illustrated in FIG. 3(*c*).

Namely, during the writing operation the controller 224 receives the output data from the PCM expanding circuit 31*a* which are sent out in response to the clock signals having the frequency of $f_s/k$ (period of t×k) and successively writes the output data of 8 bit in accordance with the first counter 222 which is counted up by the clock signals having the frequency of $f_s/k$ at the addresses indicated thereby in the RAM 221. During the reading out operation, at the moment when P pieces of data are stored in the RAM 221 the second counter 223 is incremented by +1 address by the clock signals having the frequency of $f_s$ (period t) while assuming P pieces of data as one unit, and at the moment when the data of P pieces have been read out, controller 224 returns to the first address, again reads out the same P pieces of data and repeats the same operation k times.

In order to read out P pieces of data k times uninterruptedly, it is preferable to use for the RAM 221 a memory having a capacity which can store more than 2P pieces of data and to perform the writing and reading out operations by using alternatively the two storage areas of P pieses of data. FIG. 3(*c*) shows the voice tone level conversion at this instance wherein the sampling data of the voice signals converted previously into the frequency of 250 Hz are returned and converted to the output waveform of the frequency of 1 kHz.

The sampling conversion circuit 31*b* at the reproduction side is constituted in the same manner as the sampling conversion circuit 21*b*, but like in the above the manner of control via the controller 214 is different. Accordingly, the control thereof is explained with reference to the circuit as shown in FIG. 2(*a*). The controller 214 reads out the same data which were written in the RAM 211 with the clock signals having the frequency of $f_3/k$ (period of t×k) k times with the clock signals having the frequency of $f_s$ (period t) thereby to convert the sampling data having the sampling frequency of $f_s/k$ to the data having the frequency of $f_s$. Further, in stead of sampling the same data k times, it is possible to generate (k−1) pieces of interpolation values from the latest sampling data to the present sampling data for the interval between the latest sampling data and the present sampling data, and then to add the present sampling data at the end of the interpolation data to produce k pieces of data.

The above interpolation is performed in the following manner; in that as illustrated by the dotted lines the controller 214 is provided with a calculation circuit 214*a*, a last value register 214*b* and a present value register 214*c*, the last sampling data and the present sampling data are read out at the period of t×k, the value at the last value register 214*b* is assumed as B, the value at the present value register 214*c* is assumed as A, the difference of these values S=A−B is calculated, further the value S/k is calculated, then (k−1) pieces of interpolation data A+S/k, A+2S/k, A+3S/k, . . . A+(k-l)S/k are generated, the present sampling data is added at the end of the interpolation data to produce k pieces of data and then the k pieces of data are outputted at the period of t. Further, the interpolation data can be determined by storing a plurality of previous sampling data and by processing the stored sampling data by the calculating circuit to determine optimum interpolation data.

Further, the PCM logarithmic bit compacting circuit 21*c* and the PCM expanding circuit 31*a* in the PCM compacting and expanding circuit portion can be replaced, for example, by an ADPCM compacting and expanding circuit.

In the above embodiment, the reproduction of high tone voice is performed after storing P pieces of data in the memory, therefore the processing speed thereof is delayed in comparison with that for the intermediate and low tone voice by the time relating to the storage of the P pieces of data. If such data delay affects some one the reproduced data, the output data relating to the intermediate and low tone voice are delayed via a delay circuit before the band range compounding operation so as to match the timings of the both data.

Further, in the present embodiment the high tone voice and low tone voice determined with reference to human voice other than ones for audio signals, therefore, as general standard, it is understood that voice frequency below 300 Hz is low tone voice, one from 300 Hz to 800 Hz is intermediate tone voice and one beyond about 800 Hz is high tone voice. When dividing the voice frequency into two parts the intermediate tone voice can be classified either as high tone voice or as low tone voice. Practically, the present invention is sufficiently applicable to the devices wherein the voice frequency is simply divided into high tone voice and low tone voice. Accordingly, the high tone voice filter and low tone voice filter can not necessarily be the band pass filters as disclosed in the present embodiment.

I claim:

1. A voice signal compacting and expanding device comprising:

an A/D conversion circuit which samples voice signals at a predetermined period of t and A/D converts the sampled voice signals;

a low pass digital filter which receives the output data from said A/D conversion circuit;

a high pass digital filter which receives the output data from said A/D conversion circuit and has a cutoff frequency at the low frequency side thereof which is connectable to a cutoff frequency characteristic at the high frequency side of said low pass digital filter;

a first data converting means which converts the output data from said low pass digital filter into thinned out data having a period of t×k, wherein k is an integer of 2 or more;

a second data converting means which converts P, wherein P is an integer of 2 or more pieces of the output data of said high pass digital filter into data having the period of t×k;

a first memory which receives the data converted by said first data converting means as first digital data values and the data converted by said second data converting means as second digital data values, and stores both the first and second digital data values at the same time;

a control circuit connected to said first memory, and connected to a second memory and a third memory which reads out the first and second digital data values at the same time from said first memory at the period of t×k, stores the first digital data values into said second memory and the second digital data values into said third memory respectively, produces k pieces of data based on the first digital data values stored in said second memory, outputs these respective data at the period of t successively and further outputs P pieces of data among the second digital data values stored in said third memory successively at the period of t; and a D/A converting circuit which D/A converts the first and second digital data values outputted from said control circuit.

2. A voice signal compacting and expanding device according to claim 1, wherein said first memory is a memory circuit which includes a memory and a first controller which writes the first and second digital data values at the period of t×k into said memory during recording and reads out from said memory at the period of t×k during reproducing and said control circuit includes a second controller which writes the first digital data values into said second memory at the period of t×k, and after a predetermined number of the first digital data values has been written into said second memory reads out from said second memory; and a third controller which writes the second digital data values into said third memory at the period of t×k and after a predetermined number of the second digital data values has been written into said third memory reads out from said third memory.

3. A voice signal compacting and expanding device according to claim 2, wherein said second data converting means stores the P pieces of output data from said high pass digital filter at every period of p×t×k and successively generates the stored P pieces of the data at the period of t×k, and said third controller successively accesses each of the P pieces of data among the second digital data values stored in said third memory at the period of t and outputs the same which is repeated k times to output data having the period of t.

4. A voice signal compacting and expanding device according to claim 2, wherein said second controller reads out a plurality of the first digital data values stored in said second memory, produces interpolation data based on the read out first digital data values and further produces k pieces of data.

5. A voice signal compacting and expanding device according to claim 4, wherein said second controller successively reads out the first digital data values stored in said second memory at the period of t×k, holds the last read out data, reads out the following data, produces (k−1) pieces of interpolation data between the following data and the last read out data and further produces k pieces of data from the produced interpolation data and the last read out data.

6. A voice signal compacting and expanding device according to claim 2, wherein said second controller reads out a same first digital data value stored in the second memory k times and produces k pieces of data.

7. A voice signal compacting and expanding device according to claim 1, wherein said low pass digital filter is designed to pass frequency components less than an upper limit in a range of 300 Hz 1800 Hz.

* * * * *